United States Patent [19]

Aoyama

[11] 4,168,684

[45] Sep. 25, 1979

[54] EXHAUST GAS RECIRCULATION SYSTEM

[75] Inventor: Syunichi Aoyama, Yokohama, Japan

[73] Assignee: Nissan Motor Company, Limited, Yokohama, Japan

[21] Appl. No.: 864,082

[22] Filed: Dec. 23, 1977

[30] Foreign Application Priority Data

Dec. 27, 1976 [JP] Japan ..... 51-158267

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 4,040,402 | 8/1977 | Nohira et al. | 123/119 A |
| 4,041,914 | 8/1977 | Sugihara et al. | 123/119 A |
| 4,041,917 | 8/1977 | Suzuki | 123/119 A |
| 4,044,739 | 8/1977 | Miura et al. | 123/119 A |
| 4,056,084 | 11/1977 | Baumgartner | 123/119 A |
| 4,066,056 | 1/1978 | Nohira et al. | 123/119 A |
| 4,069,797 | 1/1978 | Nohira et al. | 123/119 A |
| 4,092,960 | 6/1978 | Nohira et al. | 123/119 A |
| 4,094,287 | 6/1978 | Nohira | 123/119 A |

*Primary Examiner*—Wendell E. Burns

*Attorney, Agent, or Firm*—Schwartz, Jeffery, Schwaab, Mack, Blumenthal & Koch

[57] ABSTRACT

An EGR (Exhaust Gas Recirculation) control system comprises EGR control valve means including a first fluid chamber the vacuum in which increases and decreases in accordance with operating conditions of the engine whereby EGR control valve means control the recirculated amount of exhaust gases back to the engine and a second fluid chamber receiving therein a suction vacuum to thereby cause multiplication of the vacuum in the first chamber without altering the correspondency between the operating condition of the engine and the degree of opening of the EGR control valve means whereby the variable range of the vacuum in the first fluid chamber is optimally enlarged.

An EGR control system further comprises relief valve means for reducing the EGR ratio below a predetermined constant level upon high speed low load operating condition of the engine and which includes a fluid chamber directly communicating with the first fluid chamber of the EGR control valve means whereby the relief valve means is operated by the vacuum substantially equal to the vacuum in the first fluid chamber of the EGR control valve means.

12 Claims, 5 Drawing Figures

EXHAUST GAS RECIRCULATION SYSTEM

BACKGROUND OF THE INVENTION

The present invention relates generally to exhaust gas recirculation in an internal combustion engine and more particularly to an improvement in an EGR (Exhaust gas Recirculation) control system for controlling recirculation of exhaust gases back to the intake.

It is well known in the art that a portion of exhaust gases emitted from an internal combustion engine is recirculated back to an intake system of the engine for thereby reducing formation of oxides of nitrogen during the combustion process in the engine. However, since this exhaust gas recirculation considerably effects the combustion in the engine and consequently the operating efficiency of the engine, the exhaust gas recirculation must be strictly controlled in respect to the operating conditions of the engine. In general, for the purpose of achieving efficient reduction in formation of oxides of nitrogen without impairing the operating efficiency or the power output of the engine, it is desired to recirculate the exhaust gases at a rate proportional to the rate at which combustion air flows into the engine, viz., it is desired to maintain at a predetermined or constant value the EGR ratio, which is the ratio of the recirculated amount of exhaust gases to the amount of air inducted to the engine, by weight. On the other hand, for the purpose of improving the fuel consumption of the engine, it is desired to reduce the EGR ratio below the above-mentioned predetermined value during particular operating conditions of the engine, e.g., during high speed low load operating conditions of the engine. Accordingly, it is necessary to control exhaust gas recirculation with enough consideration for the operating efficiency of the power output and the fuel consumption of the engine.

As an expedient for attaining this purpose, an EGR control system has been proposed by the same applicant as this application, which system is disclosed in U.S. Pat. application No. 817,994, filed July 21, 1977. For explanation of the background of this invention, this EGR control system is shown in FIG. 1 of the accompanying drawings of this application.

In FIG. 1, designated by the reference numeral 10 is an induction passage of an internal combustion engine (not shown), by 12 a venturi formed in the induction passage, and by 14 a throttle in the form of a rotatable throttle valve disposed in the induction passage 10 for controlling air flow to the engine. This EGR control system comprises an EGR passage 16 interconnecting an exhaust passage (not shown) and the induction passage 10 downstream of the throttle 14, a restriction or an orifice 18 formed in the EGR passage 16 for restriction of same and an EGR control valve 20 disposed in the EGR passage 16 downstream of the restriction 18. The EGR control valve 20 includes a flexible diaphragm 22, and first and second fluid chambers 23 and 24 separated by the diaphragm 22 from each other. The fluid chamber 23 communicates with the induction passage 10 downstream of the throttle 14 through a passage 25 for receiving therein a suction vacuum, and the fluid chamber 24 communicates with the atmosphere through a port 24'. A valve stem 26 is fixedly connected at its one end to the diaphragm 22 so as to be movable therewith as one body. A valve head 27 is integrally connected to the other end of the valve stem 26 and is sealingly seatable on a valve seat 28 disposed in the EGR passage 16 downstream of the restriction 18. A spring 29 is disposed in the fluid chamber 23 for urging the diaphragm 22 in the direction of the valve seat 28. By the EGR control valve 20 thus constructed and arranged as above, the EGR passage 16 is provided with a chamber or a passage zone 16' defined between the restriction 18 and the EGR control valve 20. A pressure regulating valve assembly 30 is provided for controlling the flow of atmospheric air admitted into the fluid chamber 23 for dilution of the suction vacuum therein in accordance with a venturi vacuum in the venturi 12 and the pressure (Pe) in the passage zone 16' defined between the orifice 18 and the EGR control valve 20. For that purpose, the pressure regulating valve assembly 30 includes four chambers 31, 32, 33 and 34, and three diaphragms 36, 38 and 40 respectively separating the above four chambers as shown in the drawing. These three diaphragms 36, 38 and 40 are fixedly connected to each other so that they are operated as one body. The chamber 31 communicates with the atmosphere through openings 42 and further with the passage 25 through a passage 44 which has an inlet port 44' disposed in the chamber 31. The chamber 32 communicates with the venturi 12 through a passage 46 for receiving therein the venturi vacuum. The chamber 33 communicates with the atmosphere through an opening 33'. The chamber 34 communicates with the passage zone 16' of the EGR passage 16 through a passage 47 for receiving therein the pressure (Pe) in the passage zone 16'. The diaphragm 36 is cooperative with the inlet port 44' of the passage 44 to create a valve effect, viz., the diaphragm 36 is movable relative to the inlet port 44' to control the flow of atmospheric air admitted into the passage 44.

The pressure regulating valve assembly 30 thus described briefly is thus operative to increase and reduce the vacuum in the chamber 23 of the EGR control valve 20 in accordance with the venturi vacuum and the pressure (Pe) as follows.

Upon an increase of the venturi vacuum in response to an increase of the amount of air to the engine, the diaphragms 36, 38 and 40 are integrally moved in the direction to close the inlet port 44' to reduce the flow rate of atmospheric air admitted into the passage 44 thus reducing dilution of the vacuum in the chamber 23 of the EGR control valve 20. As a result, the degree of opening of the EGR control valve 20 is increased thus causing decrease of the pressure (Pe) in the passage zone 16' and therefore the pressure in the chamber 34 of the pressure regulating valve assembly 30. When the pressure (Pe) in the passage zone 16' and therefore the pressure in the chamber 34 of the pressure regulating valve assembly 30 are thus reduced, the diaphragms 36, 38 and 40 are, on the contrary, actuated to move in the direction to open the inlet port 44' of the passage 44 to increase the flow rate of atmospheric air into the passage 44. As a result, the dilution of the vacuum in the chamber 23 is increased to reduce the degree of opening of the EGR control valve 20 thus causing an increase of the pressure (Pe) in the passage zone 16'. By the repetition of an operation thus described as above, the degree of opening of the EGR control valve 20 and therefore the pressure (Pe) in the passage zone 16' are converged to the values in which the pressure (Pe) is proportioned to the venturi vacuum so that the flow rate of recirculated exhaust gases is increased and reduced in accordance with increase and decrease of the venturi varuum.

In this EGR control system, the amount of recirculated exhaust gases through the EGR passage 16 is a function of the pressure differential across the restriction 18, viz., upstream and downstream of the restriction 18, and the size of the restriction 18. In this regard, the pressure in the EGR passage upstream of the restriction 18 is approximately equal to the pressure in the exhaust passage (not shown). The exhaust passage pressure is a positive pressure the absolute value of which is relatively small, in other words, the exhaust passage pressure varies within a relatively narrow range through the flow rate of exhaust gases passing through the exhaust passage varies within a relatively wide range in response to the variations of the operating conditions of the engine. Therefore, when the absolute value of the pressure (Pe) in the passage zone 16' is set at a desirable large value as compared to the pressure in the EGR passage upstream of the restriction 18 and is controlled by the EGR control valve 20 in a manner as has been explained hereinbefore, the pressure differential across the restriction 18 is proportioned to the flow rate of combustion air to the engine. Accordingly, the flow rate of recirculated exhaust gases is controlled in proportion to the flow rate of combustion air flowing into the engine.

This EGR control system further has such a function as follows: When the pressure (Pe) in the passage zone 16' changes regardless of the venturi vacuum by the effect of the variations of the suction vacuum in the induction passage 10, the pressure regulating valve assembly 30 operates the EGR control valve 20 to move in the direction to cancel the variations of the pressure (Pe) having been resulted as above. To explain this function of the EGR control system in more detail, when the pressure (Pe) is a negative pressure and this is increased regardless of the venturi vacuum, the diaphragms 36, 38 and 40 are integrally moved in the direction to open the inlet port 44' by the amount corresponding to the increase of the pressure (Pe). As a result, the degree of opening of the EGR control valve 20 is reduced in a manner as has been explained hereinbefore, thus cancelling the influence of the fluctuations of the suction vacuum on the pressure (Pe). The pressure (Pe) is thus restored to its initial value. Accordingly, the flow rate of recirculated exhaust gases is assuredly prevented from being varied irrespective of the venturi vacuum.

A relief valve 48 is provided in the EGR control system and which includes a flexible diaphragm 50 and two fluid chambers 52 and 54 separated by the diaphragm 50 from each other. The fluid chamber 52 communicates with the passage 25 at a location thereof between orifices 56 and 58 through a passage 59. The fluid chamber 54 communicates with the atmosphere through a port 60. A passage 61 is provided which communicates with the passage 46 and has an inlet port 61' located in the chamber 54 for admitting into the passage 61 atmospheric air. The diaphragm 50 is cooperative with the inlet port 61' to create a valve effect, viz., the diaphragm 50 is movable relative to the inlet port 61' between two positions to open and close same to control admission of atmospheric air into the passage 61. A spring 62 is disposed in the chamber 52 for urging the diaphragm 50 in the direction of the inlet port 61', viz., in the direction to close the inlet port 61'. The chamber 52 thus constructed and arranged receives therein two vacuum signals, one of which is a suction vacuum conducted to the chamber 52 through the orifice 56 and the other of which is a vacuum prevailing in the chamber 23 of the EGR control valve and conducted to the chamber 52 through the orifice 58. Accordingly, the vacuum prevailing in the chamber 52 is a vacuum composed of the above two vacuum signals, and the vacuum in the chamber 52 increases and decreases in accordance with a vacuum prevailing in the chamber 23 of the EGR control valve. Since the suction vacuum increases as the load on the engine decreases and the venturi vacuum increases as the RPM of the engine speed increases, the vacuum in the chamber 52 is maximized upon a high speed low load operating condition of the engine. When the vacuum in the chamber 52 is above a predetermined value upon high speed low load operating condition of the engine, the diaphragm 50 is operated to move against the bias of the spring 62 into the position where it opens the inlet port 61' of the passage 61. The vacuum in the chamber 32 of the pressure regulating avle assembly 30 is therefore reduced by the atmospheric air thus causing a decrease of the vacuum in the chamber 23 of the EGR control valve 20. As a result, the degree of opening of the EGR control valve 20 is reduced whereby the flow rate of recirculated exhaust gases is temporarily modified to a decreased value in this high speed low load operating condition of the engine.

Since the formation of oxides of nitrogen during combustion process of the engine does not take place appreciably when the engine is operated in high speed low load operating condition, the above reduction of the flow rate of recirculated exhaust gases in this operating condition of the engine does not cause any drawback to the emission control effect achieved by the EGR control system, but the combustion efficiency of the engine is improved markedly. As a result, the operating efficiency of the engine, e.g., fuel consumption and operation stability of the engine, is improved.

In this EGR control system as have been thus explained, the spring constant, viz., the ratio of supplied force to resulting deflection, of the spring 29 shall be set to a small value so that the vacuum prevailing in the chamber 23 of the EGR control valve 20 in high load operating condition of the engine can cause the diaphragm 22 to move against the bias of the spring 29 to the position where the EGR control valve 20 provides a predetermined opening degree thereof, because in high load operating condition of the engine the suction vacuum created in the induction passage 10 downstream of the throttle 14 and therefore the vacuum in the chamber 23 of the EGR control valve 20 are reduced to relatively small absolute values.

However, when such a weak spring is employed, the vacuum in the chamber 23 in low speed low load operating condition of the engine shall be set to a value approximately equal to zero, viz., the pressure in the chamber 23 shall be set to a value approximately equal to the atmospheric pressure, so that the EGR control valve 20 with such a weak spring 29 can close sealingly and assuredly in low speed low load operating condition of the engine. Furthermore, when such a weak spring is employed, the vacuum in the chamber 23 corresponding to high speed low load operating condition of the engine cannot be set to a large value because the bias of such a weak spring can be overcomed by a relatively small counter force.

For this reason, the variable range of the vacuum in the chamber 23 between maximum and minimum values is compelled to be set narrow.

This narrow variable range of the vacuum in the chamber 23 causes such drawbacks of the EGR control system that the operation of the EGR control valve 20 tends to be unstable and the magnitude of the vacuum to open the relief valve 48 is likely to fluctuate over a wide range relative to the variable range of the vacuum in the chamber 23. This results in deterioration of the accuracy of EGR control and therefore lack of the reliability of the EGR control system.

This EGR control system further encounters a drawback of poor responsiveness that upon deceleration of a vehicle vehicle with release of the accelerator pedal it takes a rather long response time until the EGR control system discontinues the exhaust gas recirculation. This is due to the fact that the vacuum having prevailed in the chamber 23 of the EGR control valve 20 remains therein for a relatively long time, viz., it takes a relatively long time to dilute the vacuum in the chamber 23 below a predetermined value.

It is accordingly an object of the present invention to improve an EGR control system of the foregoing type.

It is another object of the present invention to provide an improved EGR control system in which the variable range of the vacuum effective to operate an EGR control valve incorporated therein is enlarged to a desirably wide range whereby the operation of the EGR control system becomes stable.

It is a further object of the present invention to provide an improved EGR control system in which a relief valve incorporated therein operates with an increased accuracy in response to a predetermined high speed low load operating condition of the engine.

It is a still further object of the present invention to provide an improved EGR control system which discontinuous the exhaust gas recirculation with an improved responsiveness in a predetermined high speed low load operating condition of the engine.

BRIEF DESCRIPTION OF THE DRAWINGS

These and other objects and advantages of the present invention will become more apparent from the following description taken in conjunction with the accompanying drawings, in which.

DETAILED DESCRIPTIONS TO THE PREFERRED EMBODIMENTS

Figure 1:
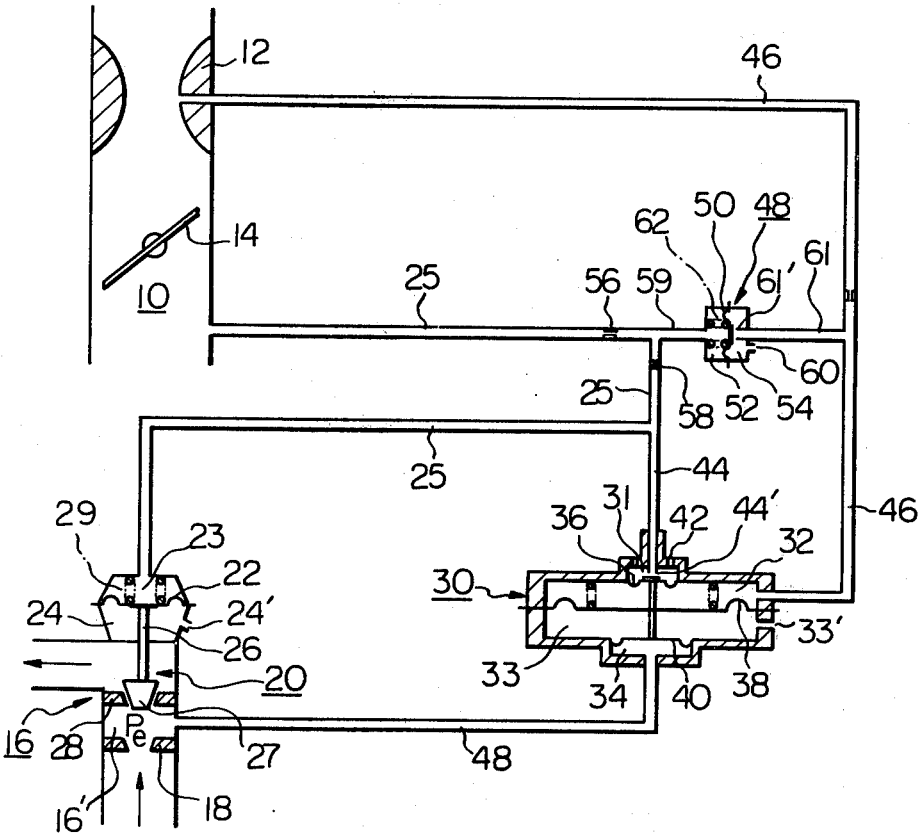
FIG. 1 is a schematic view of a formerly proposed EGR control system as per the introduction of this specification.

This invention is based on the EGR control system illustrated in FIG. 1 and contemplates mainly to improve its EGR control valve 20 such that the movement of the diaphragm 22 is further affected by a vacuum applied thereto at the opposite side to the chamber 23 to reduce the action of the vacuum in the chamber 23. Therefore, like elements as those used in the EGR control system of FIG. 1 are used in FIGS. 2, 4 and 5, and they have been given the same numerals and will not be described again for brevity.

Figure 2:
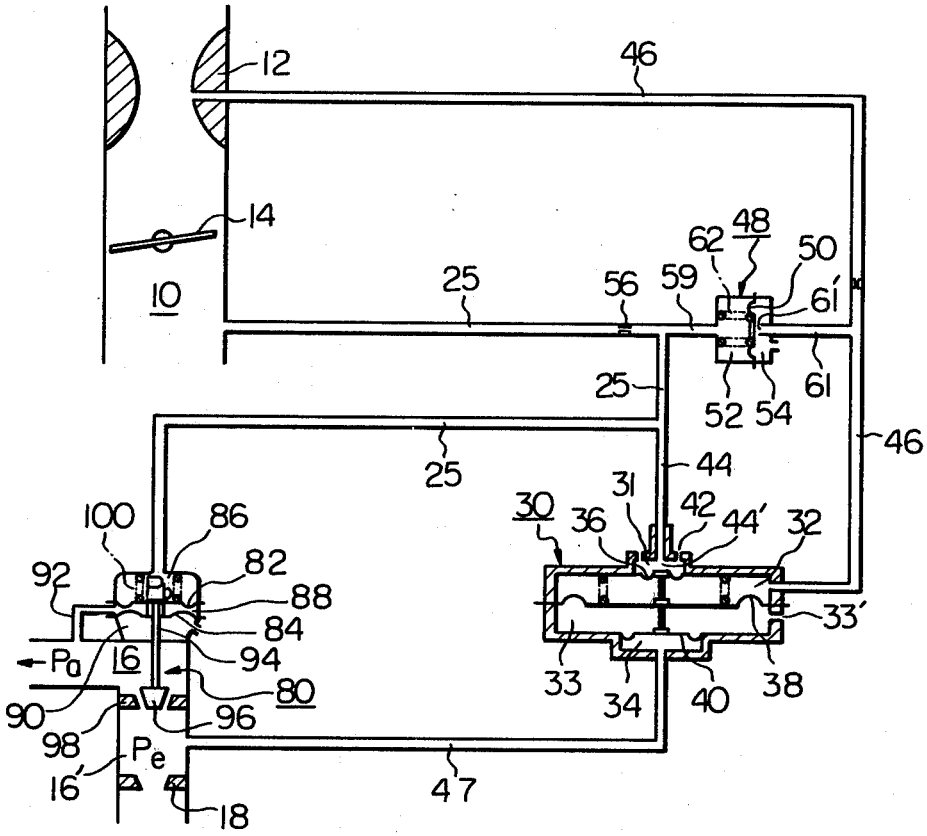
FIG. 2 is a schematic view of a first preferred embodiment of an EGR control system according to the present invention.
Figure 3:
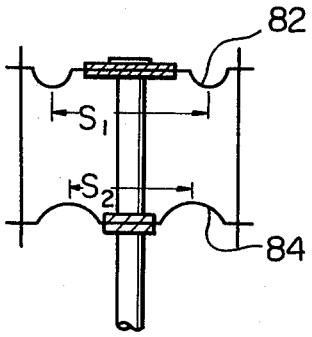
FIG. 3 is an enlarged schematic view showing the arrangement of diaphragms incorporated in the EGR control system of FIG. 2.

Referring to FIG. 2, an EGR control system, first embodiment of the present invention, comprises an EGR control valve 80 which includes two flexible diaphragms 82 and 84 and three fluid chambers 86, 88 and 90. The fluid chamber 86 communicates with the induction passage 10 downstream of the throttle 14 through the passage 25 to receive therein a suction vacuum . The fluid chamber 88 is fluidly connected to the induction passage 10 downstream of the throttle 14 to receive therein a suction vacuum through the EGR passage 16 and a passage 92 providing communication between the chamber 88 and the EGR passage 16 downstream of the EGR control valve 80. The fluid chamber 90 communicates with the atmosphere. The diaphragm 82 has a larger effective working area than the diaphragm 84 and separates the chambers 86 and 88, and the diaphragm 84 separates the chambers 88 and 90. The above-mentioned effective working area means the part of the diaphragm enclosed within or defined by an effective diameter which part of the diaphragm is flexed or moved upwardly and downwardly as viewed in the drawing in response to the variations of the vacuum acting thereon. As shown in FIG. 3, the diaphragm 82 is constructed to have a effective working area $S_1$ which is larger than the effective working area $S_2$ of the diaphragm 84. The peripheral part of the diaphragm 82 or 84 excluded by the effective diameter is constructed to counteract the displacement of the inner part of the diaphragm included within the effective diameter.

In this instance, the passage 92 for conducting suction vacuum to the chamber 88 is of a considerably short length. Since suction vacuum created in the induction passage 10 also prevails in the part of EGR passage 16 downstream of the EGR control valve 80, the chamber 88 receives therein a suction vacuum through such a passage 92 of a short length.

The diaphragms 82 and 84 are integrally interconnected to be movable as one body and are connected to one end of a valve stem 94. The other end of the valve stem 94 is fixedly connected with a valve head 96 which is sealingly seatable in a valve seat 98 disposed in the EGR passage 16 downstream of the restriction 18. The valve head 96 is cooperative with the valve seat 98 to increase and reduce the opening degree of the EGR control valve 80 in accordance with upward and downward movements of the diaphragms 82 and 84. A spring 100 is disposed in the chamber 86 for urging the diaphragms 82 and 84 in the direction of the valve seat 98, i.e. in the direction to cause the valve head 96 to seat in the valve seat 98.

The EGR control system of this invention is not provided with the orifice 58 which is arranged in the EGR control system of FIG. 1, viz., the chamber 52 of the relief valve 48 communicates directly with the chamber 86 of the EGR control valve 80 and the chamber 31 of the pressure regulating valve assembly 30 without passage through such an orifice 58 as is provided in the EGR control system of FIG. 1. By this omission of the orifice 58, the vacuum in the chamber 52 of the relief valve 48 is substantially equal to the vacuum in the chamber 86 of the the EGR valve 80, on the other hand, in the EGR control system of FIG. 1 the vacuum in the chamber 52 is a vacuum composed of two vacuum signals as has been described referring to FIG. 1.

By thus constructing and arranging the EGR control system, the correspondency between the magnitude of the vacuum in the chamber 86 and the degree of opening of the EGR control valve 80 is improved optimally by the effect of the vacuum in the chamber 88, viz., the vacuum in the chamber 86 is multiplied by the effect of the vacuum in the chamber 88 to correspond to the same degree of opening of the EGR control valve.

This multiplication of the vacuum in the chamber 86 is obtained as follows:

When assuming $S_1$ and $S_2$ as the effective working areas of the diaphragms 82 and 84 respectively, Pb as the vacuum prevailing in the chamber 86 and Pa as the vacuum prevailing in the chamber 88, the diaphragm 82 receives a force expressed by $Pb.S_1$ in the direction to open the EGR control valve 80 and further receives a force expressed by $Pa(S_1-S_2)$ and a biasing force F by the spring 100 in the direction to close the EGR control valve 80. The EGR control valve 80 therefore tends to reduce its degree of opening by the amount corresponding to the effect of the vacuum in the chamber 88. However, when the degree of opening of the EGR control valve is thus reduced below a predetermined degree of opening corresponding to the operating condition of the engine, the pressure (Pe) in the passage zone 16' is increased, viz., since the pressure (Pe) is normally a negative pressure the vacuum (Pe) is reduced. Since the pressure (Pe) thus increased is conducted to the chamber 34 of the pressure regulating valve assembly 30, the diaphragm 40 is caused to move upwardly as viewed in the drawing together with the diaphragms 36 and 38 thus causing a decrease of the flow rate of atmospheric air into the passage 44 through the inlet port 44'. The amount of atmospheric air fed to the chamber 86 for dilution of the vacuum therein is thus reduced, and consequently the vacuum in the chamber 86 is increased, viz., the absolute value of the vacuum in the chamber 86 is increased.

Accordingly, the thus increased amount of the vacuum in the chamber 86 causes the diaphragms 82 and 84 to move upwardly cancelling the influence of the vacuum in the chamber 88 whereby the EGR control valve 80 retains the former predetermined degree of opening.

From the above description, it is appreciated that by the action of the vacuum in the chamber 88 on the diaphragm 82 against the action of the vacuum in the chamber 86 on same the vacuum in the chamber 86 is multiplied to correspond to the same degree of opening of the EGR control valve. In other words, when the EGR control system of FIG. 2 and the EGR control system of FIG. 1 in a condition in which their EGR control valves are operated to provide the same degree of opening, the absolute value of the vacuum in the chamber 86 is larger than same in the chamber 23.

As will be further appreciated, the provision of this chanmber 88 does not alter the EGR control characteristics of the EGR control system of this invention as compared to the EGR control system of FIG. 1. Because, when the venturi vacuum in the venturi 12 is increased in response to the increase of the flow rate of intake air to the engine, the diaphragm 38 is moved upwardly together with the diaphragms 36 and 40 to reduce the amount of atmospheric air admitted to the passage 44 thus causing increase of the vacuum in the chamber 86. As a result, the degree of opening of the EGR control valve 80 is increased thus causing decrease of the pressure (Pe) in the passage zone 16'. Resultantly, the pressure differential across the restriction 18 is increased to increase the flow rate of recirculated exhaust gases such that the EGR ratio is maintained at a predetermined value. When, on the contrary, the venturi vacuum is decreased in response to the decrease of the flow rate of intake air to the engine, the degree of opening of the EGR control valve 80 is decreased thus causing the decrease of the pressure differential across the restriction 18 whereby the EGR ratio is maintained at a predetermined value by reducing the flow rate of recirculated exhaust gases by the amount corresponding to the decrease of the venturi vacuum.

The pressure (Pe) in the passage zone 16' downstream of the restriction 18 fluctuates influenced by the variations of the suction vacuum prevailing in the part of the EGR passage 16 downstream of the EGR control valve 80, thus causing the variations of the EGR ratio, e.g., when the suction vacuum is increases the EGR ratio is increased to a value larger than a predetermined value. This fluctuation of the pressure (Pe) is compensated in a similar manner as has been explained with respect to the EGR control system of FIG. 1, viz., by a feed of the pressure (Pe) to the chamber 34 of the pressure regulating valve assembly 30.

Accordingly, it will be appreciated that the control of the pressure (Pe) conducted in the EGR control system according to the present invention contributes to provide two different effects, one of which is a multiplication effect of multiplying the vacuum in the chamber 86 in accordance with the suction vacuum fed to the chamber 88, and the other of which is a compensation effect of compensating the fluctuations of the EGR ratio resulted from the variations of the suction vacuum.

From the foregoing description, it will be appreciated that the vacuum in the chamber 86 is multiplied increasingly as the suction vacuum fed to the chamber 88 increases. Accordingly, the variable range of the vacuum in the chamber 86 is expanded wider as compared to the variable range of the vacuum in the chamber 23 in the EGR control system of FIG. 1. Furthermore, even when the EGR control valve 80 is operated to provide a relatively small degree of opening as compared to its maximum degree of opening, the absolute value of the vacuum in the chamber 86 is held at relatively large value as compared to the vacuum in the chamber 23 of FIG. 1. This means that a certain amount of variation in the vacuum in the chamber 86 results in a relatively small amount of variation in the degree of opening of the EGR control valve 80 as compared to a similarly resulting amount of variation in the EGR control system of FIG. 1. Therefore, the operation of the EGR control system of FIG. 2 is stable, viz., the performance characteristics of the EGR control system of FIG. 2 is stable and therefore reliable, whereas the operation of the EGR control system of FIG. 1 is rather unstable because the EGR control system of FIG. 1 varies the degree of its EGR control valve opening relatively largely in response to a relatively small amount of variation in the vacuum for actuating the EGR control valve, viz., the EGR control system of FIG. 1 has ON-OFF type performance characteristics.

Upon a sudden deceleration mode of the engine, the resultantly increased suction vacuum prevails in the chamber 88 of the EGR control valve 80 instantly and without delay at the beginning of the deceleration mode of the engine, thus causing the diaphragms 82 and 84 to move downwardly overcoming an action against thereto which action is provided when the dilution of the vacuum in the chamber 88 is not completed yet. The flow of recirculated exhaust gases is thus terminated or reduced instantly at the beginning of the deceleration mode of the engine whereby the driveability and the fuel consumption of the engine are improved optimally. From this, it is appreciated that the responsiveness of the EGR control system according to this invention is improved markedly.

The operation of the relief valve 48 is also improved optimally due to the enlarged variable range of the vacuum in the chamber 86. In this regard, the chamber 52 of the relief valve 48 of the EGR control system of FIG. 2 communicates directly with the chamber 86 without such an orifice 58 as is provided in the EGR control system of FIG. 1. The relief valve 48 of the EGR control system of FIG. 1 is fed with two vacuum signals which are diluted by the effects of the orifices 56 and 58, while the relief valve 48 of the EGR control system of FIG. 2 is fed with a vacuum substantially equal to the vacuum prevailing in the chamber 86 which has been multiplied proportionally in accordance with the suction vacuum as has been explained hereinbefore. Therefore, the magnitude of the vacuum causing the relief valve 48 of FIG. 2 to open is set at a value larger than same of FIG. 1. Therefore, the operation of the relief valve 48 of the EGR control system of FIG. 2 is assured and reliable, viz., the relief valve is assured to open in response to the vacuum in the chamber 52 above a predetermined level.

The vacuum in the chamber 86 of the EGR control valve 80 is maximized when the suction vacuum fed to the chamber 88 and the venturi vacuum fed to the chamber 32 of the pressure regulating valve assembly 30, viz., in high speed low load operating condition of the engine. Since the vacuum in the chamber 52 of the relief valve 48 is varied correspondingly to the vacuum in the chamber 86 of the EGR control valve 80, the relief valve 48 is operated to open in high speed low load operating condition of the engine to dilute the vacuum in the chamber 32 of the pressure regulating valve assembly 30 whereby the EGR ratio is reduced in a manner as has been explained hereinbefore.

In this instance, opening and closing operations of the relief valve 48 correspond with an improved accuracy to predetermined operating conditions of the engine due to the enlarged variable range of the vacuum in the chamber 86. Because in practical use of the relief valve 48 the magnitude of the vacuum causing the relief valve 48 to open sometimes diverges from a predetermined value, viz., there is, on some occasions, an error in the magnitude of the vacuum which causes the relief valve 48 to open. However, the relative amount of this error in respect to the variable range of the vacuum in the chamber 52 is smaller than the corresponding relative amount of the error in the EGR control system of FIG. 1. Therefore, the relief valve 48 of FIG. 2 is responsive to the predetermined high speed low load operating condition of the engine with an increased accuracy. Accordingly, the EGR control system according to the present invention performs optimally such that it reduces the EGR ratio exactly in a predetermined high speed low load operating condition of the engine whereby the driveability and fuel consumption of the engine are improved efficiently.

Figure 4:
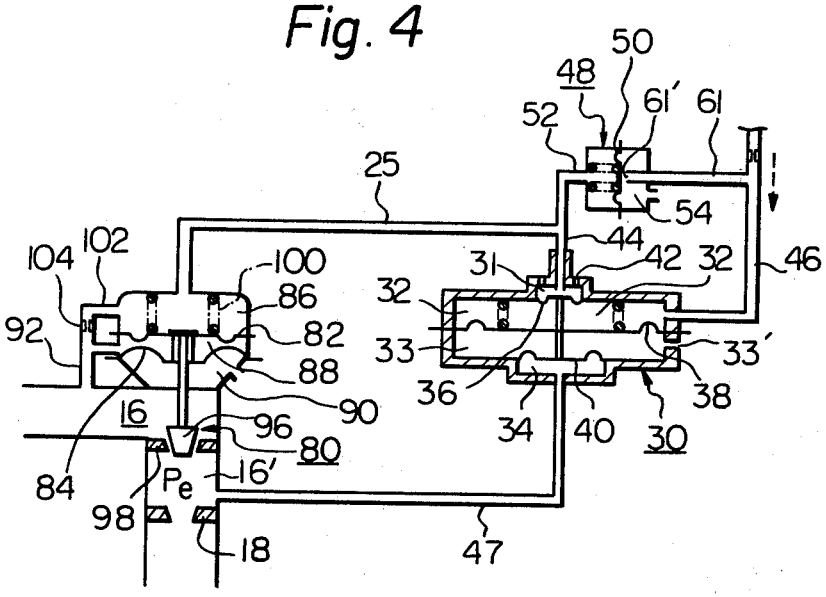
FIG. 4 is a schematic view of a second preferred embodiment of an EGR control system according to the present invention in which parts thereof common to FIG. 2 are omitted.
Figure 5:
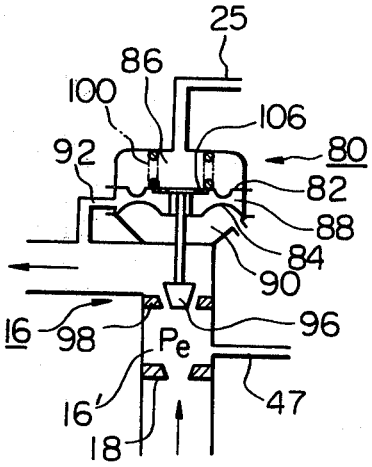
FIG. 5 is a schematic view of a third preferred embodiment of an EGR control system according to the present invention in which parts thereof common to FIG. 2 are omitted.

Reference is now made to FIGS. 4 and 5. FIG. 4 shows a second preferred embodiment of an EGR control system according to the present invention. The difference between this second embodiment and the first embodiment of FIG. 2 is the passage structure for conducting suction vacuum in the induction passage 10 to the chamber 86 of the EGR control valve 80, viz., in place of the part of the passage 25 of FIG. 2 extended from the induction passage 10, a passage 102 having disposed therein an orifice 104 is provided which is connected at its end to the passage 92 and at the other end to the chamber 86. The chamber 86 of the EGR control valve 80 is thus fluidly connected to the induction passage 10 downstream of the throttle 14 through the passages 102 and 92 and through the EGR passage 16 to receive therein a suction vacuum smoothed by the effect of the orifice 104. However, since the chamber 86 communicates with the chamber 31 of the pressure regulating valve assembly 30, the suction vacuum fed to the chamber 86 is diluted by atmospheric air in the same manner as is achieved in the first embodiment of FIG. 2. Therefore, the vacuum in the chamber 86 increases and decreases in accordance with venturi vacuum in the venturi 12 and the pressure (Pe) in the EGR passage zone 16' in the same manner as is achieved in the first embodiment of FIG. 2. Accordingly, the operation of the EGR control valve of FIG. 4 is identical to same of FIG. 2.

FIG. 5 shows a third preferred embodiment of an EGR control system according to the present invention, but parts thereof common to the second embodiment of FIG. 4 are omitted.

The difference between this third embodiment and the second embodiment is the passage structure for conducting a suction vacuum in the induction passage 10 to the chamber 86 of the EGR control valve 80, viz., in place of the part of the passage 102 of FIG. 4, an orifice or orifices 106 are formed in the diaphragm 82 to provide communication between the chamber 86 and the chamber 88 whereby the chamber 86 receives therein the suction vacuum prevailing in the chamber 88. Since the chamber 86 communicates with the chamber 31 of the pressure regulating valve assembly 30, the suction vacuum in the chamber 86 is modified in the same manner as is achieved in the first embodiment of FIG. 2. Therefore, the operation of the EGR control valve 80 of the third embodiment of FIG. 5 is identical to the first embodiment of FIG. 2.

Since the second and third embodiments are constructed to conduct to the chamber 86 of the EGR control valve 80 a suction vacuum having been smoothed by the action of the orifices 104 and 106, the operation of the EGR control valve becomes further stable.

By thus modifying the passage structure of the first embodiment, the responsiveness of the EGR control system according to the present invention is further improved optimally since the passage structures of the second and third embodiments are simplified as compared to the first embodiment.

The operation of the relief valve 48 in the second and third embodiments is identical to that in the first embodiment because the chamber 52 of the relief valve 48 communicates with the first chamber 86 of the EGR control valve 80 so as to be operated by the vacuum substantially equal to the vacuum in the first chamber 52.

What is claimed is:

1. An exhaust gas recirculation (EGR) control system in combination with an internal combustion engine having an induction passage for air flow to the engine, a throttle disposed in said induction passage for controlling air flow therethrough, a venturi formed in said induction passage and an exhaust passage for exhaust gas flow from the engine, said EGR control system comprising:

an EGR passageway interconnecting said exhaust passage and said induction passage downstream of said throttle for recirculation of the exhaust gases therethrough;

a restriction formed in said EGR passage for restricting said EGR passageway;

EGR control valve means disposed in said EGR passageway downstream of said restriction and operative to increase and reduce the pressure (Pe) in a passage zone of the EGR passageway between said restriction and said EGR control valve means, said EGR control valve means including first and second chambers and a flexible diaphragm separating said first and second chambers, said first chamber communicating with said induction passage to receive therein a vacuum from a vacuum source and being arranged such that upon an increase of the vacuum in said first chamber said diaphragm is moved in the direction to cause a decrease of the pressure (Pe) to increase the recirculated flow of the exhaust gases, and said second chamber being fluidly connected to said induction passage to receive therein a vacuum created in said induction passage downstream of said throttle and being arranged such that upon an increase of the vacuum in said second chamber said diaphragm is moved in the direction to cause an increase of the pressure (Pe) in said passage zone to reduce the recirculated flow of the exhaust gases; and pressure regulating valve means operative to increase and reduce the vacuum in said first chamber by controlling the flow of atmospheric air admitted into said first chamber in accordance with the pressure (Pe) in said passage zone and venturi vacuum in said venturi.

2. An EGR control system as claimed in claim 1, in which said EGR control valve means further comprises:

a third chamber communicating with the atmosphere;

a second diaphragm having a smaller effective working area than said first diaphragm separating said first and second chambers, said second diaphragm separating said second and third chambers;

a valve stem integrally connected at its one end to said first and second diaphragm to integrally move therewith;

a valve head fixedly connected to the other end of said valve stem;

a valve seat disposed in said EGR passageway, said valve head being arranged to be sealingly seatable in said valve seat; and biasing means disposed in said first chamber for urging said first and second diaphragms in the direction of said valve seat.

3. An EGR control system as claimed in claim 1, in which said EGR control valve means further comprises:

first passage means providing communication between said second chamber and said EGR passageway downstream of said EGR control valve means.

4. An EGR control system as claimed in claim 1, further comprising:

second passage means providing communication between said venturi and said pressure regulating valve means for conducting therethrough venturi vacuum in said venturi;

third passage means communicating with said second passage means and having an inlet port communicating with the atmosphere for admitting into said third passage means atmospheric air to dilute the venturi vacuum in said second passage means; and relief valve means operatively connected to said third passage means and movable relative to said inlet port to open and close same in accordance with operating conditions of the engine, said relief valve means being constructed and arranged to normally close said inlet port and to open same in high speed low load operating condition of the engine to cause decrease of the flow of the recirculated exhaust gases.

5. An EGR control system as claimed in claim 4, in which said relief valve means comprises:

a fourth chamber communicating with said first chamber;

a fifth chamber communicating with the atmosphere;

a third flexible diaphragm separating said fourth and fifth chambers and movable relative to said inlet port of said third passage means to open same in response to the vacuum in said first chamber being above a predetermined value; and biasing means disposed in said fourth chamber for urging said third diaphragm in the direction of said inlet port of said third passage means to close same in response to the vacuum in said first chamber being below a predetermined value, whereby in high speed low load operating condition of the engine said relief valve means is operated to open said inlet port of said third passage means to cause decrease of the recirculated flow of the exhaust gases.

6. An exhaust gas recirculation (EGR) control system in combination with an internal combustion engine having an induction passage for air flow to the engine, a throttle disposed in said induction passage for controlling air flow therethrough, a venturi formed in said induction passage and an exhaust passage for exhaust gas flow from the engine, said EGR control system comprising:

an EGR passageway interconnecting said exhaust passage and said induction passage downstream of said throttle for recirculation of the exhaust gases therethrough;

a restriction formed in said EGR passageway for restricting said EGR passageway;

EGR control valve means disposed in said EGR passageway downstream of said restriction and operative to increase and reduce the pressure (Pe) in a passage zone of the EGR passageway between said restriction and said EGR control valve means, said EGR control valve means including first and second chambers, a flexible diaphragm separating said first and second chambers and first passage means having at least one orifice and providing communication between said first and second chambers, said second chamber being fluidly connected to said induction passage to receive therein a vacuum created in said induction passage downstream of said throttle and being arranged such that upon an increase of the vacuum in said second chamber said diaphragm is moved in the direction to cause an increase of the pressure (Pe) in said passage zone to reduce the recirculated flow of the exhaust gases, and said first chamber receiving therein the vacuum in said second chamber through said passage means and being arranged such that upon an increase of the vacuum in said first chamber said diaphragm is moved in the direction to cause a decrease of the pressure (Pe) in said passage zone to thereby increase the recirculated flow of the exhaust gases; and pressure regulating valve means operative to increase and reduce the vacuum in said first chamber by controlling the flow of atmospheric air into said first chamber in accordance with the pressure (Pe) in said passage zone and a venturi vacuum in said venturi.

7. An EGR control system as claimed in claim 6, in which said orifice of said first passage means is formed in said diaphragm.

8. An EGR control system as claimed in claim 6, in which said first passage means is disposed outside said first and second chambers.

9. An EGR control system as claimed in claim 6, in which said EGR control valve means further comprises second passage means providing communication between said second chamber and said EGR passageway downstream of said EGR control valve means.

10. An EGR control system as claimed in claim 6, in which said EGR control valve means further comprises:

a third chamber communicating with the atmosphere;

a second diaphragm having a smaller effective working area than said first diaphragm separating said first and second chambers, said second diaphragm separating said second and third chambers;

a valve stem integrally connected at its one end to said first and second diaphragms to integrally move therewith;

a valve head fixedly connected to the other end of said valve stem;

a valve seat disposed in said EGR passage, said valve head being arranged to be sealingly seatable in said valve seat; and biasing means disposed in said first chamber for urging said first and second diaphragms in the direction of said valve seat.

11. An EGR control system as claimed in claim 6, further comprising:

third passage means providing communication between said venturi and said pressure regulating valve means for conducting therethrough venturi vacuum in said venturi;

fourth passage means communicating with said third passage means and having an inlet port communicating with the atmosphere for admitting into said fourth passage means atmospheric air to dilute the venturi vacuum in said third passage means; and relief valve means operatively connected to said fourth passage means and movable relative to said inlet port to open and close same in accordance with operating conditions of the engine, said relief valve means being constructed and arranged to normally close said inlet port and to open same in high speed low load operating condition of the engine to cause decrease of the recirculated flow of the exhaust gases.

12. An EGR control system as claimed in claim 6, in which said relief valve means comprises:

a fourth chamber communicating with said first chamber;

a fifth chamber communicating with the atmosphere;

a third flexible diaphragm separating said fourth and fifth chambers and movable relative to said inlet port of said fourth passage means to open same in response to the vacuum in said first chamber being above a predetermined value; and biasing means disposed in said fourth chamber for urging said third diaphragm in the direction of said inlet port of said fourth passage means to thereby close same in response to the vacuum in said first chamber being below a predetermined value, whereby in high speed low load operating condition of the engine said relief valve is operated to open said inlet port of said fourth passage means to cause decrease of the recirculated flow of the exhaust gases.

* * * * *